US006748188B2

(12) United States Patent
Kishigami et al.

(10) Patent No.: US 6,748,188 B2
(45) Date of Patent: Jun. 8, 2004

(54) ROTARY DEVELOPING APPARATUS

(75) Inventors: Minoru Kishigami, Nagano-Ken (JP); Yasuhiro Matsuo, Nagano-Ken (JP); Satoru Miyamoto, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/189,370

(22) Filed: Jul. 3, 2002

(65) Prior Publication Data

US 2003/0026627 A1 Feb. 6, 2003

(30) Foreign Application Priority Data

Jul. 5, 2001 (JP) ..... 2001-204152

(51) Int. Cl.[7] ..... G03G 15/01
(52) U.S. Cl. ..... 399/227; 74/354
(58) Field of Search ..... 399/227, 226, 399/223, 228, 75; 74/352, 354

(56) References Cited

U.S. PATENT DOCUMENTS 4,030,445 A * 6/1977 Takenaga et al. ..... 399/227
4,743,938 A * 5/1988 Ohno ..... 399/227
5,168,319 A * 12/1992 Kimura et al. ..... 399/227
5,495,327 A 2/1996 Inobata
5,585,911 A * 12/1996 Hattori et al. ..... 399/227

FOREIGN PATENT DOCUMENTS

| | | |
|---|---|---|
| JP | 61-95370 | 5/1986 |
| JP | 61-99169 | 5/1986 |
| JP | 61-105565 | 5/1986 |
| JP | 5-94086 | 4/1993 |

* cited by examiner

*Primary Examiner*—Arthur T. Grimley
*Assistant Examiner*—Ryan Gleitz
(74) *Attorney, Agent, or Firm*—Sughrue Mion, PLLC

(57) ABSTRACT

A rotary developing apparatus having a plurality of developing devices mounted along the outer periphery of a cylindrical rotary unit. A first gear train for connecting the rotary unit to a drive source to rotate the rotary unit. A second gear train for connecting a developing roller of a developing device revolved and stopped at a developing position, as a result of the rotary unit being rotationally driven, to the drive source to rotate the developing roller. The rotary unit and the developing roller are rotated with the same motor used as the drive source by switching between the connections of the gear trains, thereby rapidly damping vibration generated by the rotation of the rotary unit and vibration generated by the rotation of the developing roller, and thus eliminating image defects due to displacement, etc.

1 Claim, 5 Drawing Sheets

ROTARY DEVELOPING APPARATUS

BACKGROUND OF THE INVENTION

The present invention relates to a rotary developing apparatus having a plurality of developing devices mounted along the outer periphery of a rotary unit with a cylindrical shape.

In conventional full-color image forming apparatus adopting the rotary developing method, a plurality of developing devices are mounted along the outer periphery of a rotary unit, and each developing device is successively revolved to a developing position to perform a developing operation. For this purpose, driving means for rotating the rotary unit and driving means for rotating a developing roller contained in each developing device on the rotary unit are provided separately from each other.

The above-described rotary unit equipped with a plurality of developing devices is generally in the shape of an approximately circular cylinder and has heavy members mounted near the outer periphery of the circular cylinder, such as developing rollers serving as developer carriers, which are metallic rollers or rollers each comprising a metallic core and an elastic material covering the core, to develop a latent image formed on a latent image carrier, e.g. a photosensitive member. Therefore, the rotary unit has a large moment of inertia.

In a general full-color printing operation using developing devices for four colors, for example, 90-degree rotation of the rotary unit is performed four times, whereby the developing devices for four colors are successively moved to a developing position at which each developing device faces the photosensitive member to perform a developing operation. After being stopped at the developing position for performing a developing operation, the rotary unit is held in this position, for example, by using the holding force of the motor, or an engagement member provided separately.

In the 90-degree rotating operation, when the inertia moment of the rotary unit is large, the motor used as a drive source needs to generate correspondingly large force. Further, an effective way of increasing the printing speed of the apparatus is to increase the speed of the 90-degree rotating operation. However, if the speed of the 90-degree rotating operation is increased, acceleration acting during the rotation increases correspondingly. Consequently, force required from the drive source becomes greater because the force for rotation acts against the moment of inertia with the square of acceleration.

The force for rotation exerts an influence adversely when the rotation of the rotary unit is stopped. To stop the rotation of the rotary unit, the drive source functions as a brake to damp the rotational force of the rotary unit. Ideally, it is desirable that the rotational force should be made zero by the braking force immediately before the rotary unit comes to a stop.

In actual practice, however, the rotational force undesirably remains owing to backlash and play in the gear train of the driving system, deflection, torsion of the rotary unit, etc. The residual rotational force is transmitted to the whole apparatus as vibration through the drive source when the rotary unit is stopped. The vibration is transmitted to the exposure means and the latent image carrier, causing displacement to occur during the formation of a latent image. If the vibration is transmitted to the transfer part, transfer displacement may occur.

When the driving means for rotating the developing roller starts its operation immediately after the rotation of the rotary unit has stopped, unevenness of rotation of the driving means or vibration occurring at the drive source is transmitted to the whole apparatus through the drive source. The vibration causes image defects to occur owing to displacement, etc. as in the case of the vibration generated at the time of stopping the rotary unit.

The above-described two drive sources have respectively different rotation and vibration characteristics when the drive sources are different in type or lot from each other. Even if the two drive sources have substantially equal vibration characteristics, if they are installed at different places, there will be influence of vibration characteristics of the places where the drive sources are installed. Therefore, vibrations from the two drive sources are likely to consist of different components and hence remain without damping. Under certain circumstances, the vibrations are combined together in such a manner as to be superimposed on one another and thus amplified. This causes image defects such as displacement over a long period.

SUMMARY OF THE INVENTION

The present invention was made to solve the above-described problems.

Accordingly, an object of the present invention is to rapidly damp vibrations generated by the rotation of a rotary unit and by the rotation of a developing roller, thereby eliminating image defects due to displacement, etc.

To attain the above-described object, the present invention provides a rotary developing apparatus having a plurality of developing devices mounted along the outer periphery of a cylindrical rotary unit. The rotary developing apparatus is characterized by having: a first gear train for connecting the rotary unit to a drive source to rotate the rotary unit; a second gear train for connecting a developing device revolved and stopped at a developing position, as a result of the rotary unit being rotationally driven, to the drive source to drive the developing device; and drive switching means for switching between the first gear train and the second gear train to connect either of them to the drive source.

The first gear train connects the drive source to an input gear of the rotary unit through a rotary drive gear, and the second gear train connects the drive source to an input gear of the developing device through a development drive gear. The drive switching means may be a switching solenoid for switching between the connection of the drive source through the rotary drive gear and the connection of the drive source through the development drive gear. The drive switching means may be a combination of a rotary unit clutch for connecting the drive source to the input gear of the rotary unit, and a development clutch for connecting the drive source to the input gear of the developing device. The development clutch may be a one-way clutch.

DESCRIPTION OF PREFERRED EMBODIMENTS

Figure 1:
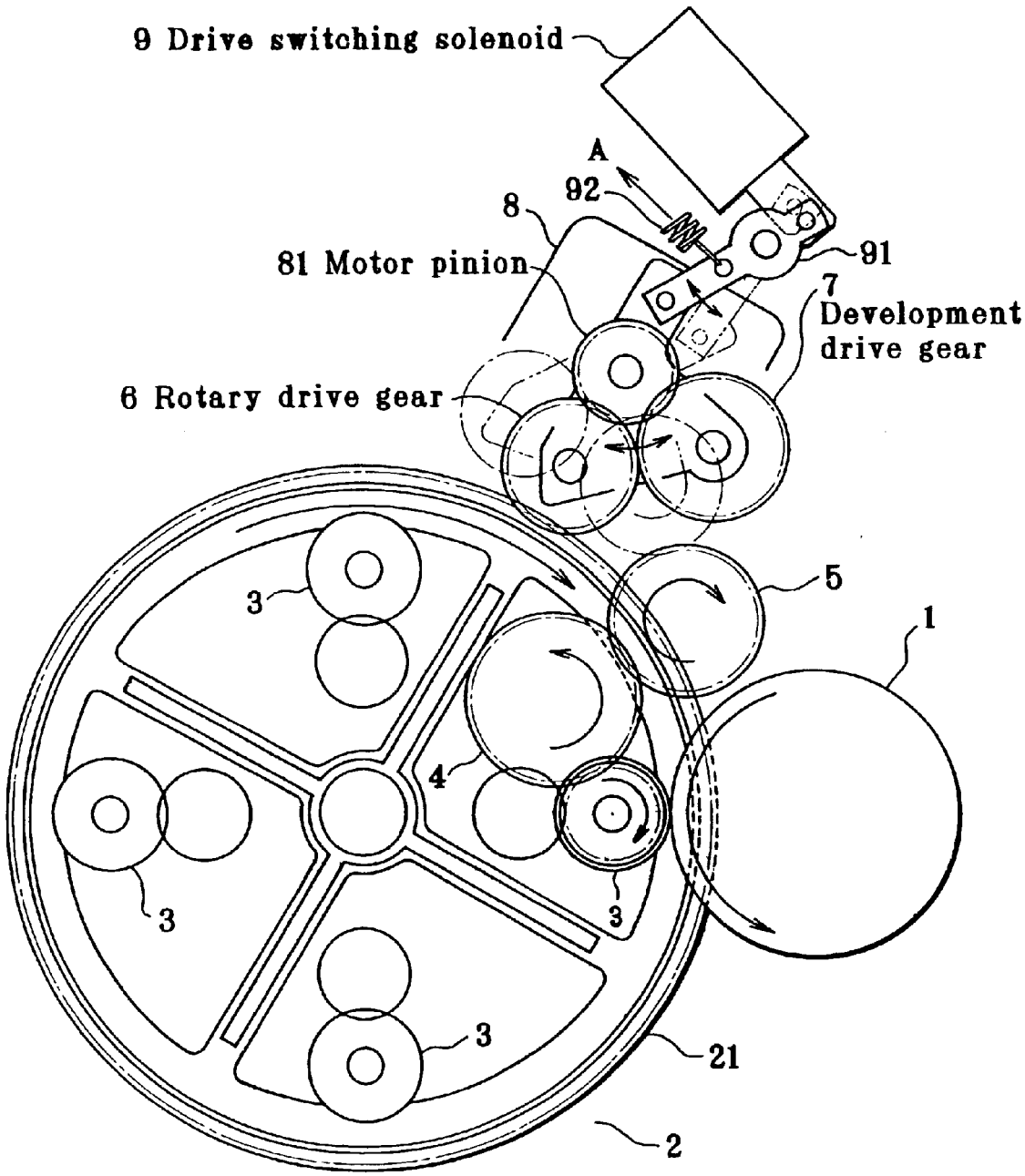
FIG. 1 is a diagram showing an embodiment of the rotary developing apparatus according to the present invention.

In FIG. 1, a rotary unit 2 shows an example of a unit configuration for four-color development in which developing devices for yellow Y, cyan C, magenta M and black K are mounted. The rotary unit 2 is in the shape of an approximately circular cylinder and has a plurality of developing devices mounted near the outer periphery of the circular cylinder to develop a latent image formed on a latent image carrier, e.g. a photosensitive member 1. The rotary unit 2 has a rotary input gear 21 positioned in concentric relation to the center of rotation of the rotary unit 2. The rotary input gear 21 is driven to rotate through a gear train including a motor 8 as a drive source. In the gear train, the rotary input gear 21 is operatively connected to a rotary drive gear 6 that is in mesh with a motor pinion 81 of the motor 8.

Each developing device has a developing roller 3 serving as a developer carrier, which is a metallic roller or a roller comprising a metallic core and an elastic material covering the core. The developing roller 3 uses the motor 8 as a drive source in common with the rotary unit 2. The developing roller 3 is driven to perform a developing operation through a gear train in which a development input gear 4 is operatively connected through an idler gear 5 to a development drive gear 7 that is in mesh with the motor pinion 81 of the motor 8.

When the rotary developing apparatus is equipped with developing devices for four colors, 90-degree rotation of the rotary unit 2 is performed four times by using the motor 8 as a drive source, thereby successively moving the developing devices for four colors to a developing position at which each developing device faces the photosensitive member 1. At the developing position, the rotation of the rotary unit 2 is stopped to perform a developing operation. A drive switching solenoid 9 is not energized but kept deenergized during the rotation of the rotary unit 2, thereby allowing the rotary drive gear 6 and the rotary input gear 21 to be operatively connected to each other. After the rotary unit 2 has stopped rotating to perform a developing operation, the drive switching solenoid 9 is energized. Consequently, the rotary drive gear 6 is disconnected from the rotary input gear 21 as shown by the dashed-and-dotted line in the figure. At the same time, the development drive gear 7 and the idler gear 5 are connected to each other.

In a normal state where the drive switching solenoid 9 is not energized, a switching lever 91 is placed in the solid-line position shown in the figure by a spring 92. When the drive switching solenoid 9 is energized, the switching lever 91 is moved to the position shown by the dashed-and-dotted line in the figure. The rotary drive gear 6 and the development drive gear 7 are each in mesh with the motor pinion 81 and caused to revolve about the axis of the motor pinion 81 by displacement of the switching lever 91 due to energization of the drive switching solenoid 9. In this way, the rotary drive gear 6 and the development drive gear 7 are each switched from the solid-line position to the dashed-and-dotted line position shown in the figure.

Thus, the rotary drive gear 6 and the development drive gear 7 are caused to revolve about the axis of the motor pinion 81 while being kept in mesh with the motor pinion 81 by the drive switching mechanism comprising the drive switching solenoid 9, the switching lever 91 and the spring 92, thereby switching between two gear trains. That is, the drive switching mechanism switches between a first gear train for connecting the rotary unit 2 to the motor 8 as a drive source to rotate the rotary unit 2 and a second gear train for connecting the developing roller 3 of a developing device revolved and stopped at the developing position, as a result of the rotary unit 2 being rotationally driven, to the motor 8 as a drive source to rotate the developing roller 3. In this case, the first gear train comprises the motor pinion 81, the rotary drive gear 6, and the rotary input gear 21. The second gear train comprises the motor pinion 81, the development drive gear 7, the idler gear 5, and the development input gear 4.

Thus, the two gear trains can be driven with the same motor 8 by switching between the connections of the first and second gear trains. Accordingly, vibration generated by the rotation of the rotary unit 2 can be damped rapidly by starting a developing operation using the motor 8, which is a mutual drive source, immediately after the rotation of the rotary unit 2 has stopped. Consequently, it is possible to obtain a favorable image free from image defects due to displacement or the like.

Figure 2:
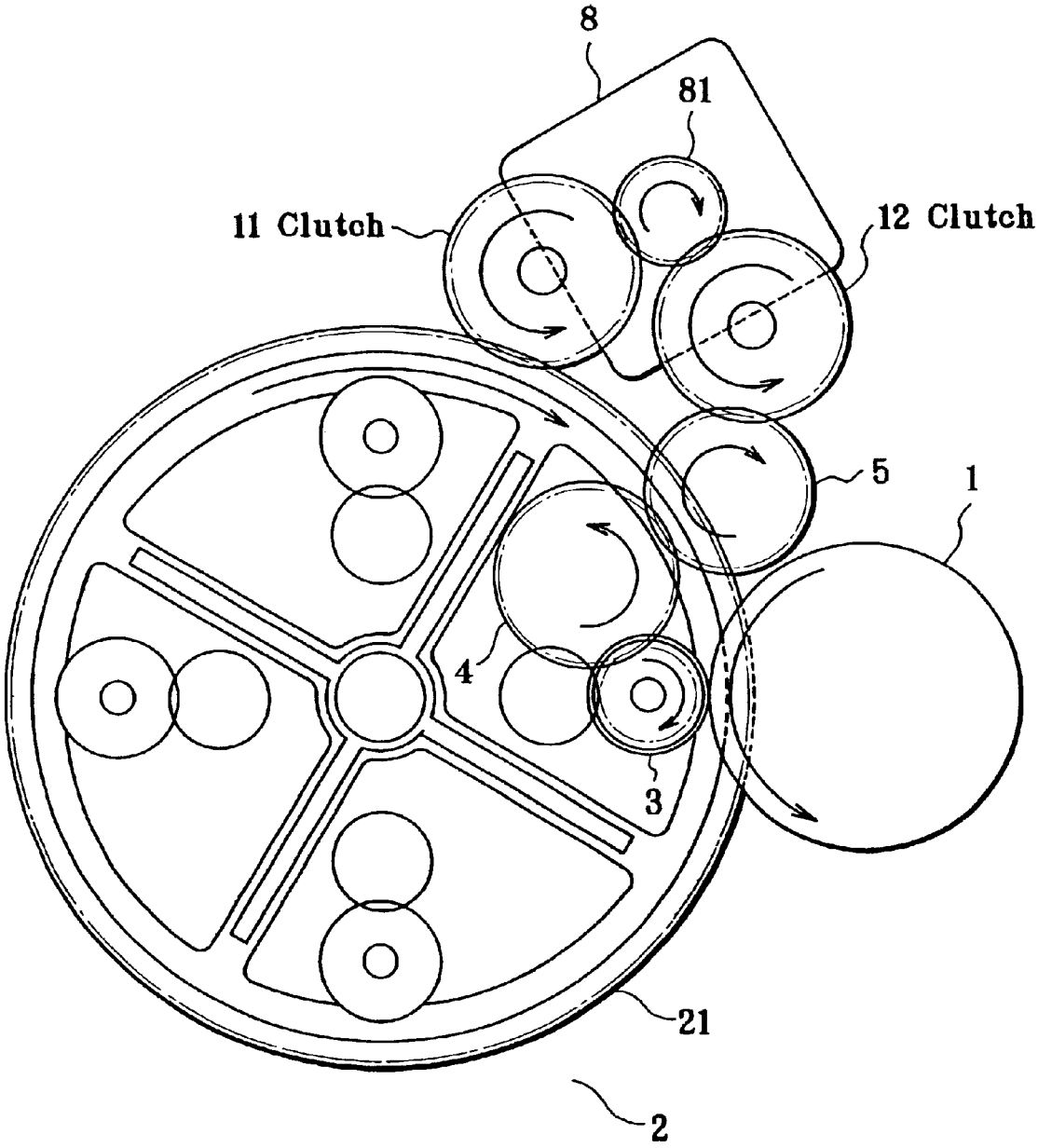
FIG. 2 is a diagram showing an embodiment of the rotary developing apparatus according to the present invention that uses clutches in a drive switching mechanism.
Figure 3:
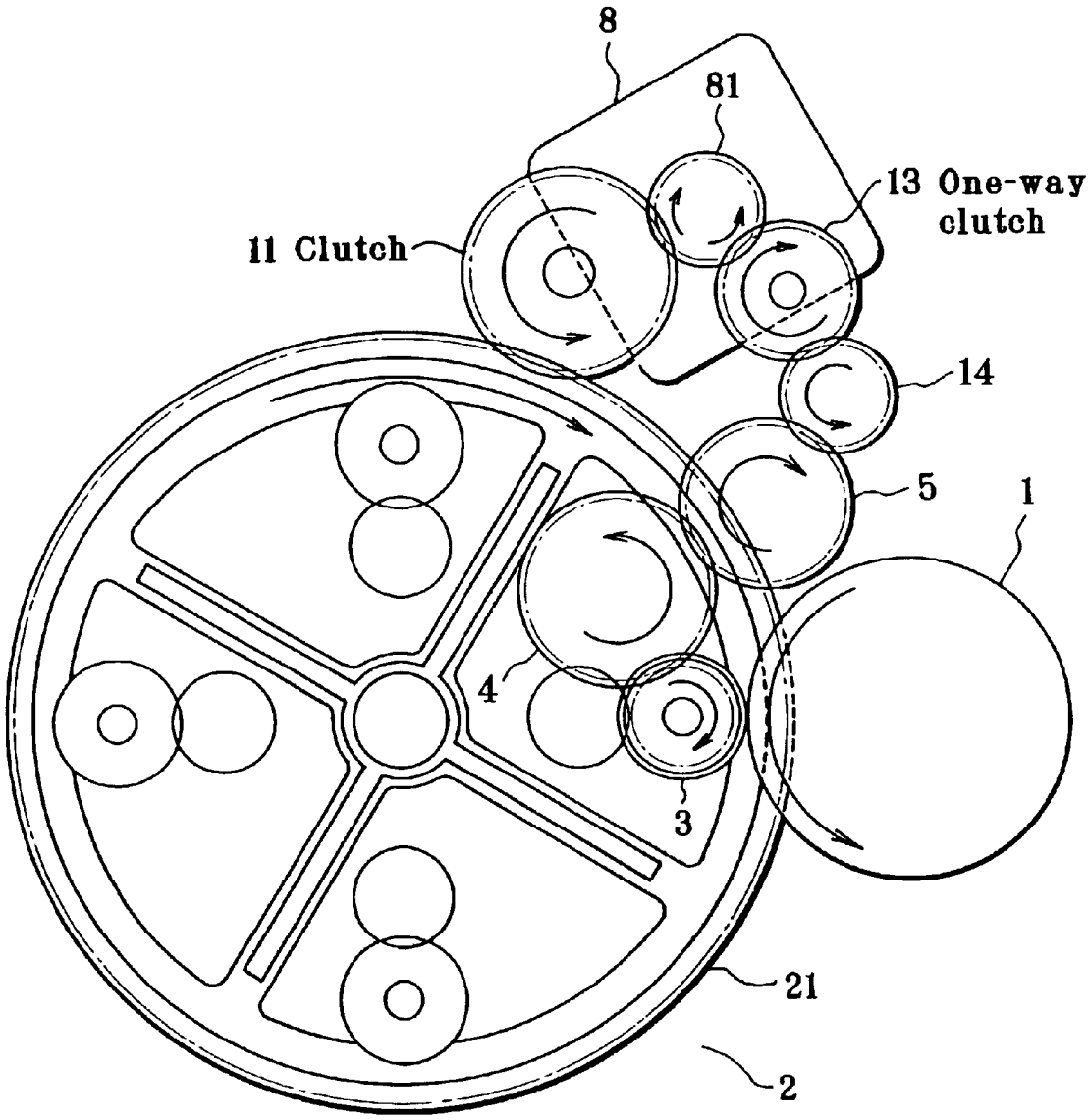
FIG. 3 is a diagram showing an embodiment of the rotary developing apparatus according to the present invention that uses a one-way clutch in a drive switching mechanism.

FIG. 2 is a diagram showing an embodiment of the rotary developing apparatus according to the present invention that uses clutches in the drive switching mechanism. FIG. 3 is a diagram showing an embodiment of the rotary developing apparatus according to the present invention that uses a one-way clutch in the drive switching mechanism. In the figures, reference numerals 11 and 12 denote clutches. Reference numeral 13 denotes a one-way clutch, and reference numeral 14 denotes an idler gear.

In the embodiment shown in FIG. 2, the clutch 11 is incorporated into the first gear train for connecting the rotary unit 2 to the motor 8 to rotate the rotary unit 2. The clutch 12 is incorporated into the second gear train for connecting the developing roller 3 of a developing device revolved and stopped at the developing position, as a result of the rotary unit 2 being rotationally driven, to the motor 8 to rotate the developing roller 3. Accordingly, in both the first and second gear trains, the rotary unit 2 and the developing roller 3 can be kept connected to the motor 8 at all times. However, the drive source can be selectively connected to or disconnected from the rotary unit 2 and the developing roller 3 by the clutches 11 and 12 incorporated in the first and second gear trains, respectively. This embodiment allows switching to be effected at a higher speed than in the embodiment shown in FIG. 1, which uses the drive switching solenoid 9, by using clutches having a high response speed.

In the embodiment shown in FIG. 3, the one-way clutch 13 is incorporated into the second gear train for connecting the developing roller 3 of a developing device revolved and stopped at the developing position, as a result of the rotary unit 2 being rotationally driven, to the motor 8 to rotate the developing roller 3. The one-way clutch has no electromagnetic member and hence allows the developing roller 3 to be selectively connected to and disconnected from the drive source without a time lag. Accordingly, switching can be performed at a higher speed. The developing roller 3 may need to be prevented from rotating reversely. However, when there is a regulating member or a toner supply member, which presses against the developing roller 3, the braking force of such a member exceeds the inertia rotating force. Therefore, the one-way clutch 13 can be used in the drive gear train. On the other hand, the rotary unit 2 has a large inertia, as has already been stated, and hence needs to use a clutch 11 that is not a one-way clutch. The embodiment shown in FIG. 3 uses the clutch 11 and the one-way clutch 13 by considering the characteristics of the two clutches in combination. It should be noted that an idler gear 14 is inserted to correspond to the direction of rotation of the developing roller 3. Accordingly, the idler gears 5 and 14 may be omitted. It is also possible to use a one-way clutch for either of the idler gears 5 and 14.

Figure 4A:
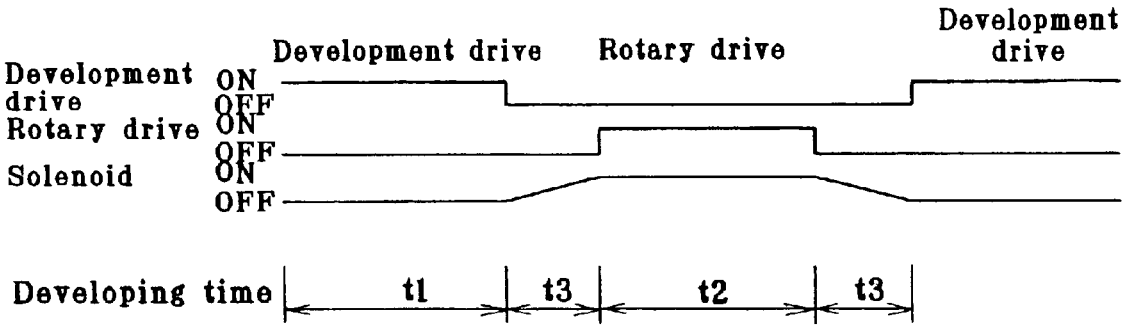
FIGS. 4(A), 4(B) and 4(C) are timing charts showing an example of operation timing in the embodiments shown in FIGS. 1 to 3.
Figure 4B:
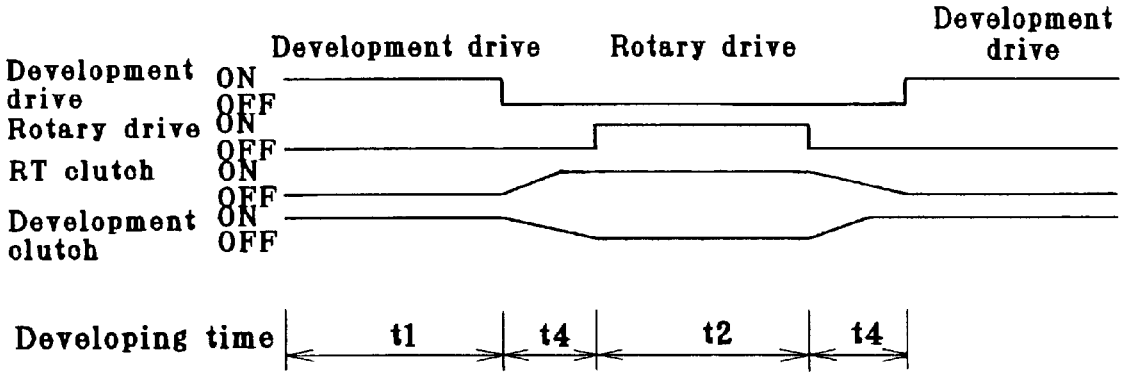
Figure 4C:
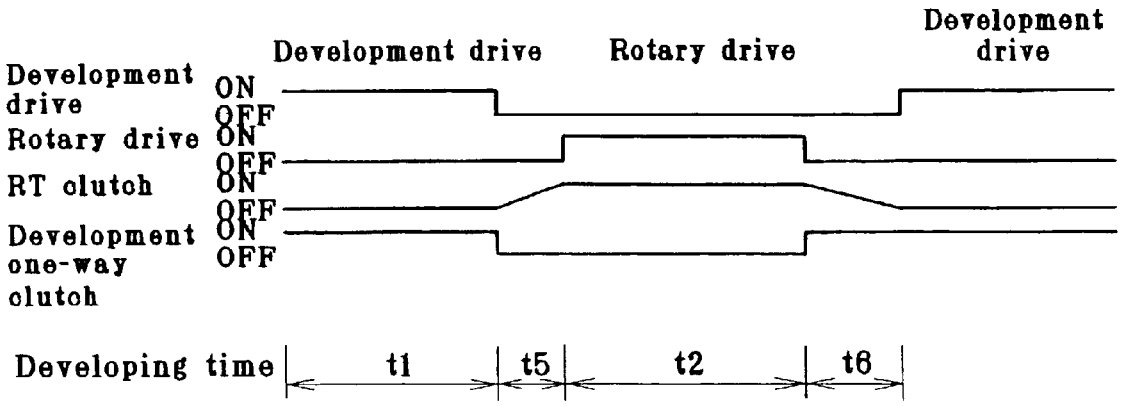
Figure 5:
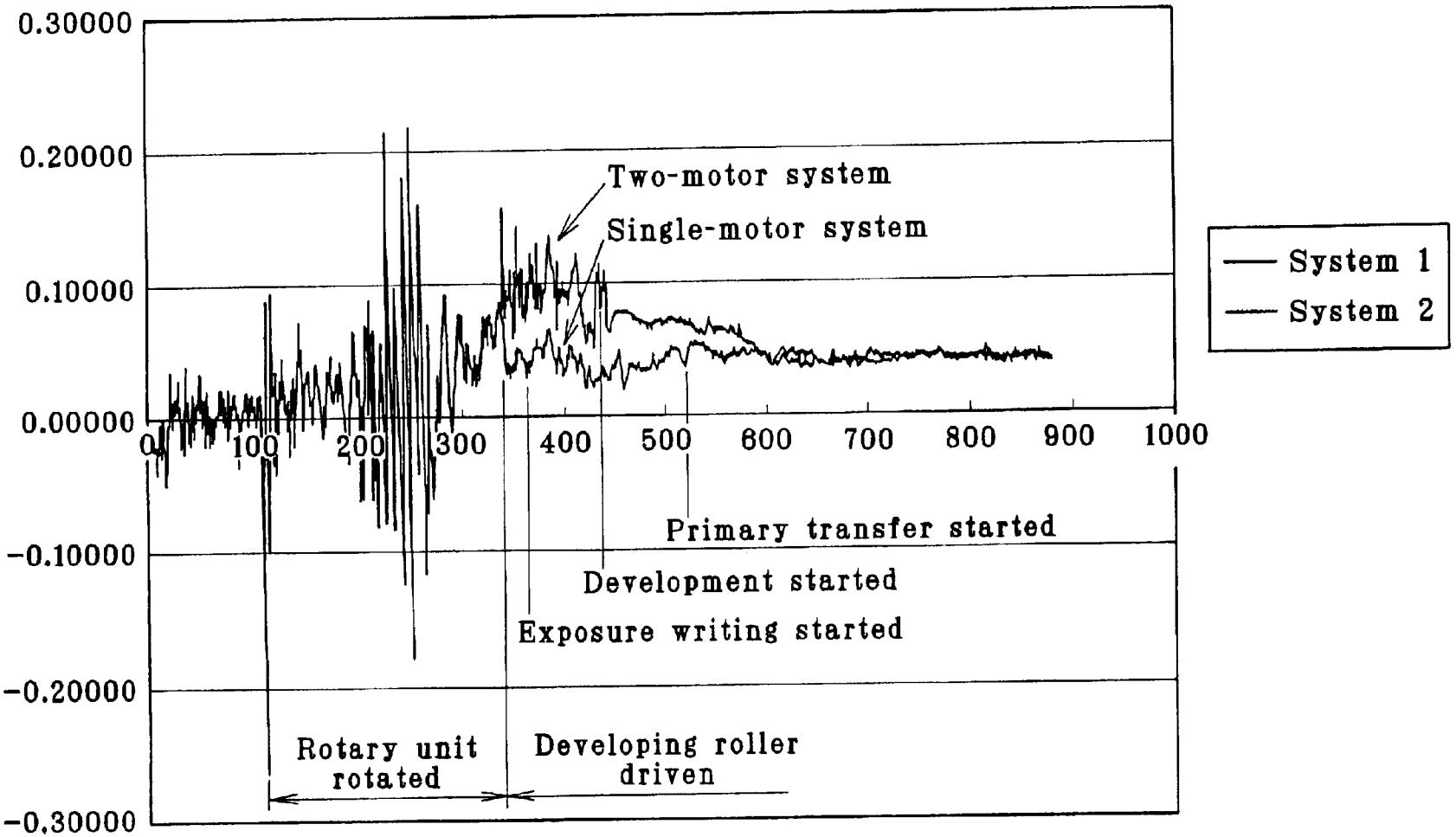
FIG. 5 is a diagram showing an example of measurement regarding the influence of vibration occurring in an apparatus adopting a single-motor system according to the present invention and in an apparatus adopting a conventional two-motor system.

FIGS. 4(A), 4(B) and 4(C) are timing charts showing an example of operation timing in the embodiments shown in FIGS. 1 to 3. FIG. 5 is a diagram showing an example of measurement regarding the influence of vibration occurring in an apparatus adopting the single-motor system according to the present invention and in an apparatus adopting the conventional two-motor system.

As has been stated above, the embodiment shown in FIG. 1 adopts the switching lever system using the drive switching solenoid 9. In this embodiment, as shown in FIG. 4(A), it takes time t1 to perform development for one color, and time t2 is required for rotation of the rotary unit 2. During time t3 between t1 and t2, the drive switching solenoid 9 is deenergized or energized to switch between the connections. The drive switching solenoid 9 is energized only during t1 or t2. Therefore, the power consumption can be reduced. Although in the foregoing embodiment shown in FIG. 1 the developing device is driven with the drive switching solenoid 9 energized, the arrangement may be such that the rotary unit 2 is driven with the drive switching solenoid 9 energized, conversely to the above.

In the embodiment shown in FIG. 2, which adopts the two-clutch system, the connections are switched from one to another by the operation of engaging or disengaging the clutches 11 and 12, and the operation stroke is shorter than in the system using the drive switching solenoid 9. Accordingly, the connections can be switched in a reduced time t4 (<t3). In the embodiment shown in FIG. 3, which adopts the clutch plus one-way clutch system, no switching time is required for the one-way clutch 13. The connections are switched from one to another by the operation of engaging or disengaging the clutch 11 to connect the rotary unit 2. Accordingly, the connections can be switched in a further reduced time t5+t6 (<2×t4).

In a rotary developing apparatus adopting the conventional two-motor system, when a developing operation is started by driving a motor different from the one used to drive the rotary unit immediately after the rotation of the rotary unit has been stopped, vibration occurring in the apparatus is further amplified by driving the motor for the developing operation as shown by the graph of the two-motor system in FIG. 5. In contrast, when a developing operation is started by driving the same motor as used to drive the rotary unit after the operation of rotating the rotary unit by the rotary developing apparatus according to the present invention, which adopts the single-motor system, vibration is damped to a considerable extent as shown by the graph of the single-motor system in FIG. 5. It should be noted that specific numerical values shown in FIG. 5 were measured with regard to a certain apparatus. The numerical values may vary for different apparatus, as a matter of course.

It should be noted that the present invention is not limited to the foregoing embodiments but can be modified in a variety of ways. For example, in the foregoing embodiments, the present invention has been described with regard to an arrangement in which the rotation of the rotary unit and the rotation of the developing roller are driven with a single motor. If the developing device contains a supply roller or/and other roller, such rollers are included in the arrangement of the present invention. Although the present invention has been described with regard to arrangements using a solenoid, a clutch and a one-way clutch as drive switching means, other switching mechanisms may also be used.

As will be clear from the foregoing description, the present invention provides a rotary developing apparatus having a plurality of developing devices mounted along the outer periphery of a cylindrical rotary unit. The rotary developing apparatus has a first gear train for connecting the rotary unit to a drive source to rotate the rotary unit, and a second gear train for connecting a developing roller of a developing device revolved and stopped at a developing position, as a result of the rotary unit being rotationally driven, to the drive source to rotate the developing roller. The rotary developing apparatus further has drive switching means for switching between the first gear train and the second gear train to connect either of them to the drive source. Accordingly, the rotary unit and the developing roller can be rotated with the same motor as a drive source by switching between the connections of the gear trains.

The first gear train connects the drive source to an input gear of the rotary unit through a rotary drive gear, and the second gear train connects the drive source to an input gear of the developing device through a development drive gear. The drive switching means may be a switching solenoid for switching between the connection of the drive source through the rotary drive gear and the connection of the drive source through the development drive gear. The drive switching means may be a combination of a rotary unit clutch for connecting the drive source to the input gear of the rotary unit, and a development clutch for connecting the drive source to the input gear of the developing device. The development clutch may be a one-way clutch. With this arrangement, the drive switching means can switch between the connections of the gear trains even more smoothly and at a higher speed.

Thus, two drive systems are driven with the same drive source, and vibration generated in one drive system is controlled with vibration generated in the other drive system. Immediately after the rotation of the rotary unit has stopped, a developing operation is started with the same motor. By doing so, vibration generated by the rotation of the rotary unit can be damped rapidly, and it is possible to obtain a favorable image free from image defects such as blur or displacement due to vibration.

What we claim is:

1. A rotary developing apparatus having a plurality of developing devices mounted along an outer periphery of a cylindrical rotary unit, said rotary developing apparatus comprising:

a first gear train for connecting said rotary unit to a drive source to rotate said rotary unit;

a second gear train for connecting a developing device revolved and stopped at a developing position, as a result of said rotary unit being rotationally driven, to said drive source to drive said developing device;

drive switching means for switching between said first gear train and said second gear train to connect either of them to said drive source;

wherein said first gear train connects said drive source to an input gear of said rotary unit through a rotary drive gear, and said second gear train connects said drive source to an input gear of the developing device through a development drive gear; and wherein said drive switching means is a switching solenoid for switching between connection of said drive source through said rotary drive gear and connection of said drive source through said development drive gear.

* * * * *